US005707223A

United States Patent [19]

Englund et al.

[11] Patent Number: 5,707,223

[45] Date of Patent: Jan. 13, 1998

[54] ROTARY SCREW COMPRESSOR HAVING A THRUST BALANCING PISTON DEVICE AND A METHOD OF OPERATION THEREOF

[75] Inventors: Arnold Englund; Karlis Timuska, both of Spånga, Sweden

[73] Assignee: Svenska Rotor Maskiner AB, Stockholm, Sweden

[21] Appl. No.: 696,901

[22] PCT Filed: Feb. 23, 1995

[86] PCT No.: PCT/SE95/00188

§ 371 Date: Aug. 22, 1996

§ 102(e) Date: Aug. 22, 1996

[87] PCT Pub. No.: WO95/23290

PCT Pub. Date: Aug. 31, 1995

[30] Foreign Application Priority Data

Feb. 28, 1994 [SE] Sweden ..... 94006731

[51] Int. Cl.[6] ..... F04C 18/16; F04C 29/10

[52] U.S. Cl. ..... 418/1; 418/203

[58] Field of Search ..... 418/1, 203

[56] References Cited

U.S. PATENT DOCUMENTS

| | | | |
|---|---|---|---|
| 3,932,073 | 1/1976 | Schibbye et al. | 418/203 |
| 3,947,078 | 3/1976 | Olsaker | 418/203 |
| 4,185,949 | 1/1980 | Lundberg | 418/203 |
| 4,964,790 | 10/1990 | Scott | 418/203 |
| 5,135,374 | 8/1992 | Yoshimura et al. | 418/203 |
| 5,207,568 | 5/1993 | Szymaszek | 418/203 |
| 5,281,115 | 1/1994 | Timuska | 418/203 |

FOREIGN PATENT DOCUMENTS

| | | | |
|---|---|---|---|
| 3-992 | 1/1991 | Japan | 418/203 |
| 4112991 | 4/1992 | Japan | 418/203 |
| 1026165 | 4/1966 | United Kingdom . | |
| WO 91/12432 | 8/1991 | WIPO . | |
| WO 95/10708 | 4/1995 | WIPO . | |

*Primary Examiner*—John J. Vrablik

*Attorney, Agent, or Firm*—Frishauf, Holtz, Goodman, Langer & Chick

[57] ABSTRACT

A rotary screw compressor having a balancing piston device for balancing an axial gas force exerted on a pair of rotors during operation of the rotary screw compressor. The balancing piston device is exposed in one axial direction to a high pressure source on at least one first pressure surface, and in an opposite axial direction to one of a low pressure source and an intermediate pressure source on at least one second pressure surface. A valve is provided for selecting the low or the intermediate pressure source connection with respect to the at least one second pressure surface, whereby the thrust balancing force can be adapted to different working conditions such as starting up and full load operation in order to avoid underbalancing or overbalancing of the axial gas force.

8 Claims, 1 Drawing Sheet

ROTARY SCREW COMPRESSOR HAVING A THRUST BALANCING PISTON DEVICE AND A METHOD OF OPERATION THEREOF

BACKGROUND OF THE INVENTION

The present invention relates to a rotary screw compressor having a balancing piston.

In compressors of this type the thrust balancing device has the function to apply a force on the rotor that counterbalances the axial gas force in order to reduce the thrust load on the bearings. Such devices are generally known in the prior art. A problem, however, arises when the outlet pressure varies and in particular when also the inlet pressure varies. In such applications the gas force will vary with the result that the rotor might be under- or overbalanced at certain working conditions. This means that the load on the bearings might fall outside the range within which a sufficient bearing running life is attained. The gas forces also in general are lower during the starting period of the compressor than during normal working conditions. There is thus a need for the possibility to vary the thrust balancing force to appropriately balance the varying axial gas force.

This problem has been recognized, and is addressed in U.S. Pat. No. 3,932,073, U.S. Pat. No. 4,964,790, U.S. Pat. No. 5,207,568,WO 91/12432 and PCT/SE 94/00947 (published as WO 95/10708).

U.S. Pat. No. 3,932,073 discloses a device with an expansion valve, which connects the high pressure side of the balancing piston with a closed working chamber in the compressor. The valve should be automatically opened or closed, and when open it creates a pressure drop over a throttling device between an oil separator and the balancing piston in a way not further described U.S. Pat. No. 4,964,790 discloses automatic regulation of balancing pressure using a microprocessor which computes a balancing pressure to be applied to the rotor in response to parameters such as suction pressure, discharge pressure and percent capacity. U.S. Pat. No. 5,207,568 discloses a pneumatical balancing piston, which is affected by a pressure connected to a closed working chamber of the compressor. The pressure in the working chamber varies according to suction pressure to cause the piston to apply a variable counterbalancing force. WO 91/12432 discloses a balancing piston having an active pressure surface that by means of a valve can be exposed either to outlet pressure, to unthrottled inlet pressure or to throttled inlet pressure and a rear pressure surface that is exposed to unthrottled inlet pressure, which normally is about atmospheric pressure. The balancing force attained therethrough can be at either of three levels and also alter direction, so that the flexibility to adapt to different running conditions is increased. PCT/SE 94/00947 discloses means for continuously varying the pressure acting on the balancing piston. These means include first and second throttles in the return pipe from the oil separator to an oil injection port. Between the throttles there is a connection to a branch pipe which ends in a cylinder which houses the balancing piston. The balancing pressure acting on the piston will thereby vary as suction and delivery pressures vary in a way determined by the relation between the degree of throttling in the two throttles.

The known devices suffer from the drawbacks of either requiring circumstantial devices for varying the balancing force or presuppose devices that normally only are present in certain applications. There is thus a need for further improvements in this field.

SUMMARY OF THE INVENTION

The object of the present invention thus is to attain a thrust balancing device of a rotary screw compressor which is simple and reliable and which can be used in applications where the known devices not are sufficiently appropriate.

The balancing device according to the invention utilizes a high pressure for the active balancing force and either of two lower pressures of different levels for the force in the opposite direction, which thus reduces the net balancing force to different extents. This allows a lower balancing force during some working conditions, when the axial gas forces are relatively low such as during starting up of the compressor, and a relatively larger balancing force under other working conditions.

Although the high, the low and the intermediate pressure sources in principle could be of any kind, it is normally convenient to make use of the different pressure levels occurring during the compression process. In some applications the inlet pressure of the compressor is higher than the ambient pressure, which normally is at atmospheric pressure. This is the case e.g. when the compressor is used for pumping up natural gas from deep wells or when the compressor is one of the later stages in a multi-stage compressor plant. In such application it can be advantageous to use the outlet pressure as the high pressure source, the ambient pressure as the low pressure source and the inlet pressure as the intermediate pressure source.

The thrust balancing device, can advantageously be divided into two separate units of somewhat different kinds.

The present invention also relates to an improved method for operating a compressor.

BRIEF DESCRIPTION OF THE DRAWINGS

The invention will be further explained through the following detailed description of a preferred embodiment thereof and with reference to the following drawings of which

DETAILED DESCRIPTION

Figure 1:
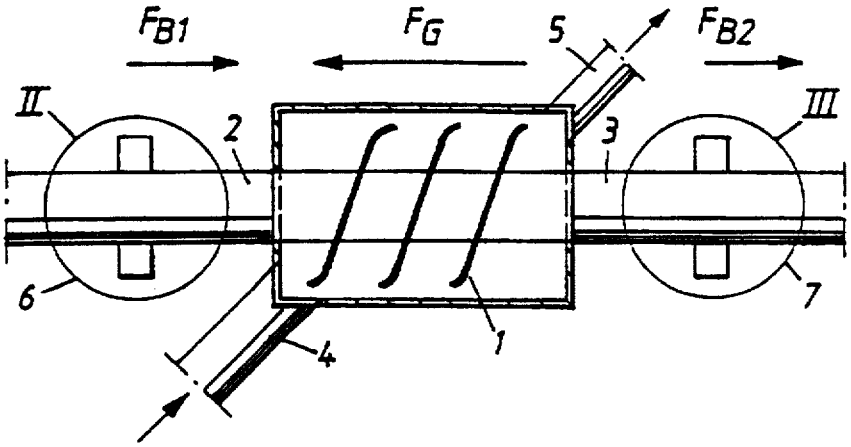
FIG. 1 is a schematic longitudinal section through a rotor of a compressor according to a preferred embodiment of the invention.

In FIG. 1 one of the rotors 1 of a rotary screw compressor is schematically illustrated in a longitudinal section. The rotor is provided with thrust balancing devices 6, 7 at its two shaft journals 2 and 3, respectively, in order to counteract the axial gas force $F_G$ acting on the rotor 1 during operation, which balancing devices 6, 7 are only symbolically indicated in FIG. 1. The working space of the rotor 1 communicates at the left end of the figure with an inlet 4 and at the right end with an outlet 5. The compressor is applied for pumping up natural gas from deep wells having a pressure that exceeds atmospheric pressure, typically in the range of 10 to 30 bars, which thus will be the inlet pressure of the compressor. The outlet pressure is in the range of 60 to 90 bars.

The axial gas force $F_g$ is directed from the outlet end to the inlet end of the compressor, i.e. leftwards in the figure, which direction in the claims is called "first axial direction". One of the balancing devices 6 is arranged around the shaft journal 2 at the low pressure end and the other one 7 around the other shaft journal 3. Through the balancing device 6 around the shaft journal 2 at the inlet end a first balancing force $F_{B1}$ acting on the rotor 1 is established and through the balancing device 7 around the shaft journal 3 at the outlet end a second balancing force $F_{B2}$ can be established. These balancing forces $F_{B1}$ and $F_{B2}$ counteract the axial gas force $F_G$ at operation.

In a manner that will be explained later, the second balancing force $F_{B2}$ can be deactivated. During starting up of the compressor or during other working conditions when the gas force $F_G$ is moderate, only the first balancing force $F_{B1}$ counteracts the axial gas force $F_G$. At full operation also the second balancing force $F_{B2}$ is activated to increase the total balancing force.

Figure 2:
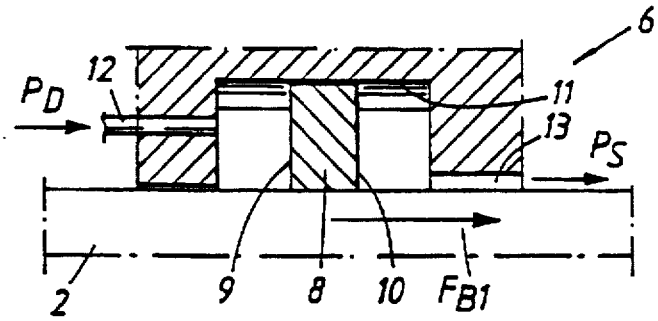
FIG. 2 is a schematic enlarged section through a detail of FIG. 1

FIG. 2 in an enlarged section illustrates the balancing device 6 on the shaft journal 2 at the inlet end, which device is of conventional kind. A balancing piston 8 is attached to the shaft journal 2 and rotates therewith, and is operating with a small clearance in a cylinder 11 in the compressor casing. A conduit 12 ends in the cylinder 11 and is connected to oil of compressor outlet pressure, e.g. an oil separator in the compressor outlet channel 5. Thus oil of outlet pressure $P_D$ is supplied to the cylinder 11 and acts on the pressure surface 9 on the left side of the balancing piston 8. The oil is drained from the right side of the piston 8 through the shaft clearance 13 to the inlet end of the compressor, where suction pressure $P_S$ prevails, which thus will be the pressure that acts on the rear surface 10 on the fight side of the piston 8. Through this device the first balancing force $F_{B1}$ is established.

Figure 3:
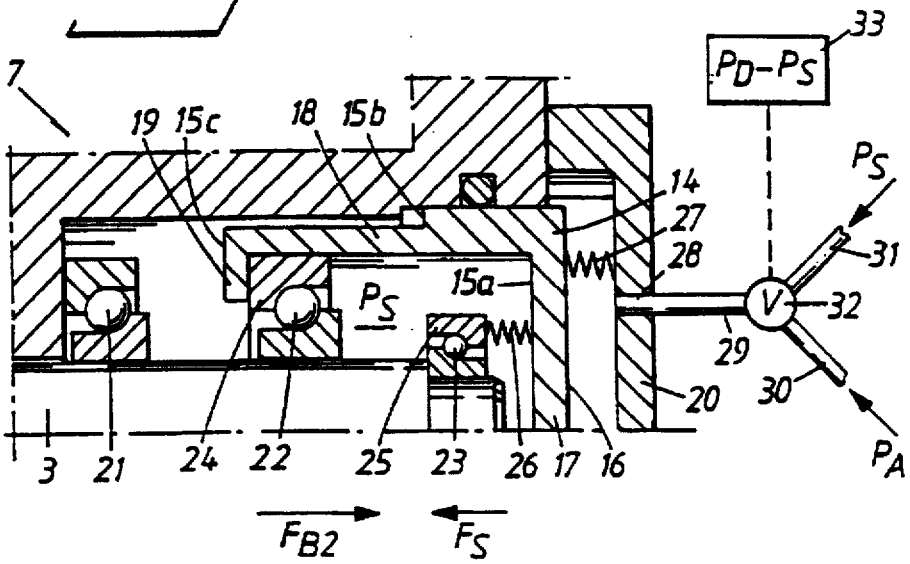
FIG. 3 is a schematic enlarged section through another detail of FIG. 1. In the figures such elements that are not of interest for understanding the present invention are left out for the sake of clarity.

FIG. 3 in a corresponding section illustrates the balancing device 7 around the shaft journal 3 at the outlet end. The balancing piston 14 located in a cylindrical cavity in the compressor casing comprises a circular section 17 axially outside the end of the shaft journal 3, a cylindrical section 18 that extends axially inwards from the circular section 17 and a flange 19 extending radially inwards from the other end of the cylindrical section 18. The balancing piston 14 is stationary and seals against the casing. An outer end surface 16 of the circular section 17 is equal to the sum of an inner surface 15*a* of said circular section 17 and a ring-shaped surface 15*b* and an end surface 15*c* corresponding to the cross section area of the wall of the cylindrical section 18. On the shaft journal 3 there is a main thrust bearing 21, a thrust balancing bearing 22 and a preloading 23. The main thrust bearing 21 is supported by the compressor casing and the thrust balancing bearing 22 with outer ring 24 is supported by the flange 19 of the balancing piston 14.

Between the outer ring 25 of the preloading bearing 23 and the axially inner surface 15*a* of the circular section 17 of the balancing piston there is provided a first mechanical pressure spring 26, with a spring force $F_{F1}$ acting rightwards on the balancing piston 14 for preloading the thrust balancing bearing 23 and the thrust balancing bearing 22 supported by the flange 19. Axially outside the balancing piston 14 there is provided a closure element 20 rigidly connected to the compressor casing. Between this closure element 20 and the outer surface 16 of the circular section 17 of the balancing piston 14 there is a second mechanical pressure spring 27 having the spring force $F_{F2}$, which is smaller than the $F_{F1}$, preferably about $0,5 \times F_{F1}$.

The cylindrical space formed between the closure element 20 and the circular section 17 of the balancing piston 14 is through an opening 28 in the closure element 20 in communication with a conduit 29. The conduit 29 is through a three-way valve 32 connected to either a conduit 30 ending in the ambient atmosphere or a conduit 31 ending in the compressor inlet channel 4. The cavity to the left of the balancing piston is constantly kept in communication with the compressor inlet channel establishing a pressure of $P_S$ within this cavity.

The device operates in the following way: During starting up of the compressor the conduit 29 is connected to the conduit 31 communicating with the compressor inlet channel. Both sides of the balancing piston 14 thus is exposed to inlet pressure $P_S$, so that the balancing force attained through the stationary balancing piston will be about zero. Due to the preloading springs 26, 27 a preloading force $F_S$, however, will act in the leftward direction to secure a minimum load on the thrust bearings 21, 22. Since the spring force $F_2$ of the outer pressure spring 27 is about half the spring force $F_1$ of the inner pressure spring 26, the main thrust bearing 21 as well as the thrust balancing bearing 22 will be preloaded by a force that is about equal to $F_2$.

When the compressor is at full load operating condition the position of the three-way valve 32 is switched so that the conduit 29 communicates with the conduit 30 connected to ambient atmosphere. Switch of the valve 32 is automatically accomplished upon signals from a control device 33, which is responsive to the pressure difference of the compressor, $P_D-P_S$. The valve 32 thus connects the conduits 29 and 30 when this pressure difference exceeds a predetermined level. When the conduit 29 is connected to the ambient atmosphere pressure, the pressure surface 16 on the outer side of the balancing piston 14 will be exposed to this atmospheric pressure $P_A$. The balancing piston 14 thus will be affected by a rightwards force $F_{B2}$ as a result of the pressure difference $P_S-P_A$ across the piston, which force is transferred to the shaft journal 3 through the thrust balancing bearing 22.

At both of the above described working conditions, the balancing device 6 around the shaft journal 2 at the other end of the rotor will remain affected by the pressure difference $P_D-P_S$ across its piston and thus all the time maintain the first balancing force $F_{B1}$.

By the virtue of the device of the present invention, an improvement is attained that the balancing force for limiting the load on the main thrust bearing 21 is substantially at either of two levels, in response to what is required at the described different operating conditions. This balancing force being $F_{B1}-F_S$ during starting and $F_{B1}+F_{B2}-F_S$ at full load operation.

Although representing a preferred embodiment of the invention, the above described example of course can be modified in various respects within the claimed scope. The invention thus can be realized with only one single balancing piston, one side thereof exposed to a high pressure and the other side to either low or intermediate pressure. Also the two balancing pistons both can be of the stationary type or both of the rotating type, and both of them can be arranged around the same shaft journal.

We claim:

1. A rotary screw compressor comprising:

a pair of rotors meshing in a working space, said rotors being subject to a gas force ($F_G$) in a first axial direction during operation of the rotary screw compressor;

wherein at least one of said rotors has a main thrust bearing and is provided with a thrust balancing piston device having a first pressure surface mechanism establishing a force in a second axial direction opposite to said first axial direction, and a second pressure surface mechanism establishing a force in said first axial direction;

wherein said first pressure surface mechanism includes at least one first pressure surface, and a first conduit connecting said at least one pressure surface to a high pressure source; and wherein said second pressure surface mechanism includes at least one second pressure surface, and a second conduit having a valve for selectively connecting said at least one second pressure surface to one of a low pressure source and an intermediate pressure source.

2. The rotary screw compressor according to claim 1, further comprising:

a compressor inlet channel and a compressor outlet channel; and wherein said high pressure source is in pressure equalizing connection with said compressor outlet channel, said low pressure source is in pressure equalizing connection with an ambient atmosphere of said rotary screw compressor, and said intermediate pressure source is in pressure equalizing connection with said compressor inlet channel.

3. The rotary screw compressor according to claim 2, wherein:

said thrust balancing piston device comprises a rotary balancing piston coupled to a first shaft journal of said at least one of said rotors, and a stationary balancing piston acting on a stationary ring of a thrust balancing bearing of a second shaft journal of said at least one of said rotors;

said rotary balancing piston comprises said at least one first pressure surface of said first pressure surface mechanism;

said stationary balancing piston comprises said at least one second pressure surface of said second pressure surface mechanism; and said first pressure surface mechanism includes a stationary rear pressure surface of said stationary balancing piston, said second pressure surface mechanism includes a rotating rear pressure surface of said rotary balancing piston, and each of said rear pressure surfaces is connected to said intermediate pressure source.

4. The rotary screw compressor according to claim 3, wherein said stationary balancing piston comprises a mechanical spring arranged to preload said main thrust bearing and said thrust balancing bearing of said second shaft journal.

5. The rotary screw compressor according to claim 3, wherein a pressure fluid acting on said rotary balancing piston comprises a liquid, and a pressure fluid acting on said stationary balancing piston comprises a gas.

6. The rotary screw compressor according to claim 1, wherein said valve comprises a control unit responsive to a pressure difference between a compressor outlet pressure and a compressor inlet pressure, and said control unit controls said valve to establish a connection with said intermediate pressure source when said pressure difference is below a predetermined level and to establish a connection with said low pressure source when said pressure difference is above said predetermined level.

7. A method for operating the rotary screw compressor of claim 1, comprising:

bringing said first pressure surface of said first pressure surface mechanism into connection with said high pressure source via said first conduit; and controlling said valve of said second conduit to bring said second pressure surface of said second pressure surface mechanism selectively into connection with one of said low pressure source and said intermediate pressure source via said second conduit.

8. The method according to claim 7, further comprising:

bringing said high pressure source into pressure equalizing connection with a compressor outlet channel;

bringing said low pressure source into pressure equalizing connection with an ambient atmosphere of said rotary screw compressor; and bringing said intermediate pressure source into pressure equalizing connection with a compressor inlet channel.

* * * * *